US005713721A

United States Patent [19]

Glynn et al.

[11] Patent Number: 5,713,721

[45] Date of Patent: Feb. 3, 1998

[54] RETENTION SYSTEM FOR THE BLADES OF A ROTARY MACHINE

[75] Inventors: Christopher C. Glynn, Hamilton; Poul D. Pedersen; Frederick M. Miller, both of Cincinnati; Roger C. Walker, Middletown; Sang Yeng Park, West Chester; Clifford C. May, Cincinnati, all of Ohio

[73] Assignee: General Electric Co., Schenectady, N.Y.

[21] Appl. No.: 644,019

[22] Filed: May 9, 1996

[51] Int. Cl.[6] ..... F04D 29/34

[52] U.S. Cl. ..... 416/220 R

[58] Field of Search ..... 416/219 R, 220 R

[56] References Cited

U.S. PATENT DOCUMENTS

| | | | |
|---|---|---|---|
| 4,400,137 | 8/1983 | Miller et al. | 416/220 R |
| 4,685,863 | 8/1987 | McLean | 416/220 R |
| 5,067,877 | 11/1991 | Youssef | 416/220 R |
| 5,350,279 | 9/1994 | Prentice et al. | 416/220 R |

FOREIGN PATENT DOCUMENTS

| | | | |
|---|---|---|---|
| 826332 | 12/1951 | Germany | 416/220 R |
| 280490 | 12/1930 | Italy | 416/220 R |

*Primary Examiner*—John T. Kwon
*Attorney, Agent, or Firm*—Nixon & Vanderhye

[57] ABSTRACT

One form of a retention system includes a pair of aft segments of 180° in length disposed in annular grooves about a compressor spool, the segments having radial projections against which the aft end faces of the base portions of rotor blades abut. The blade base portions are shaped and are received in complementary-shaped slots of the spool. The forward retention system includes a plurality of arcuate segments approximately 30° in length disposed in grooves adjacent the forward end faces of the blades. With the exception of the final pair of blades, the blade base portions thereof are located in the axial complementary slots in pairs, with each forward arcuate segment, except the final segment, being disposed in the groove at a circumferentially spaced location and displaced circumferentially to abut the forward end faces. The final arcuate segment is radially reduced and disposed in the remaining portion of the groove to lie flush with the spool. The base portions of the final blades are axially inserted over the final segments and the latter is displaced radially outwardly and pinned to abut the forward end faces of the final blade base portions. In another form, tabs project forwardly or rearwardly from the base portions of the blades. The tabs have holes in registry with corresponding holes in the blade slot for receiving pins thereby preventing axial movement of the blades relative to the spool.

6 Claims, 10 Drawing Sheets

RETENTION SYSTEM FOR THE BLADES OF A ROTARY MACHINE

TECHNICAL FIELD

The present invention relates to a blade retention system for retaining the blades of a rotary machine such as a compressor or turbine against axial movement and particularly to an axial blade retention system which does not require additional axial length between stages.

BACKGROUND

A number of different types of retention systems have been used to maintain the blades of a rotary machine, for example, turbine and compressor airfoils, against axial movement which results from gas loadings or unexpected axial forces such as compressor surge or airfoil tip rubbing. Retention systems in certain rotary machines have included staking the base portion of each blade to the disk post slot. However, new and advanced rotary machines have heavier airfoils and require stronger axial retention systems. While other types of retention systems are available, for example, in aircraft engine compressors and power generation turbines, these require a combination of rotor disk and blade hooks with a retainer ring. Such systems require additional axial length to fit the disk post hook and the blade dovetail hook.

In such new and advanced rotary machines, there is provided in the compressor section a forward spool mounting a number of bladed stages, e.g., five stages, as well as additional stages of individual disks. The forward spool must have sufficient axial gap between the stages to enable assembly and disassembly of the blades. The spool length is, however, restricted to control rotor dynamics and the flow path of the compressor rotor. The additional axial length required using conventional retention systems is a limiting factor, making such systems unavailable where additional axial gap between compressor stages in the spool cannot be provided. Other alternatives have not proved feasible due to the structural integrity of the blade dovetail and disk post slot. Consequently, there remains the problem of providing a retention system which does not increase the axial length forward and aft of the disk post slot so that the blades can be assembled without extending the rotor length.

DISCLOSURE OF THE INVENTION

In accordance with the present invention, there is provided a novel and improved retention system which retains the blades against axial forces and which does not require additional axial length for the blade spool. To accomplish this, and in a first embodiment of the present invention, forward and aft arcuate retention segments are provided on the spool to maintain the blades of certain stages against axial movement. Additionally, the aft retention system for the forwardmost stage, as well as the forward retention system for the aftmost stage of the spool employs portions of the retention system of the present invention. It will be appreciated that the directions forward and aft, as used herein, are away from and toward the turbine section of the rotary machine, respectively. For each aft retention system, there are provided preferably two 180° arcuate segments (although it will be appreciated that more than two arcuate segments may be used if desired, for examples, three 120° segments). These segments are disposed in grooves formed in the spool and have a radially outwardly projecting flange lying in axial registration with base portions of the blades, thereby limiting axial movement of the blades in the aft direction when the base portions of the blades abut the arcuate segments.

A similar but deeper groove is formed about the spool along the forward side of certain of the stages. The forward arcuate segments comprise a plurality thereof, for example, twelve 30° segments. Each of the forward segments has a recess or step on the blade side defining a radially projecting flange which, when the forward segments are in final position, engage the forward faces of the base portions of the blades to retain the blades against axial movement in a forward direction.

To install the retention system on a stage, the aft segments are first disposed in the aft groove. One or more blades, for example, a pair of blades, are disposed in the complementary, generally dovetail-shaped slots of the spool into butting engagement against the aft segments. A first forward arcuate segment is disposed in the groove at a circumferential location spaced from the installed pair of blades. This first segment is then rotated in the groove circumferentially such that its radially projecting flange is axially aligned and registers with the forward face of the base portions of the installed blades. Additional blades for that stage are assembled in like manner about the spool with each forward segment being disposed in the groove and rotated circumferentially to align it with the forward faces of the blade base portions. When the final blade or blades are to be assembled in the spool, a final forward arcuate segment having a radial depth less than the radial depth of the installed forward arcuate segments is first disposed in the groove. By locating the final forward arcuate segment in the groove with its radial outer face lying generally flush with the surface of the spool, the final blade or blades may be passed axially over this final segment into the slots. After assembly of the last blade or blades of that stage, the final forward arcuate segment is displaced radially outwardly such that its projecting flange lies in axial registration with the forward faces of the base portions of the finally installed blades. A pair of pins are disposed through the spool to maintain the final retainer segment in its radial outward projecting position, the pins being preferably staked to the disk flange.

With respect to the first stage of the compressor and the forward retention system, a conventional system may be employed in view of the significant axial spacing typically available at that location for a retention system. The retention system of the present invention may likewise be employed if desirable. With respect to the last stage of the spool, the aft retention ring on the last stage may be conventional in design.

In a second embodiment of the present blade retention system, each blade has either a forward or an aft-directed tab projecting generally axially from the blade dovetail. Whether the blades have a forward or aft tab depends on the location of the blades in the rotor spool. For example, in a certain spool arrangement, the blade dovetails of the first and third rotor stages may have forwardly directed tabs because those two stages typically have sufficient gap between the stages to permit axial installation of the blades. However, the second-stage blades have aft-directed tabs in order to assemble the blade without consuming any axial gap between the first and second stages.

To retain the blades with the forward or aft extending tabs on the rotor disk, the mating dovetail disk portion has a matching, generally radially extending hole. Upon sliding the blade dovetail generally axially along the matching disk portion, the hole through each tab is aligned with the hole in the disk portion. A pin, for example, a half-threaded pin for each blade, may be inserted into the registering holes and secured, for example, by staking in the assembly.

In a preferred embodiment according to the present invention, there is provided a blade retention system for a rotating machine comprising a hub having an axis and a plurality of shaped, generally axially extending slots at circumferentially spaced positions about the hub, a plurality of blades having complementary-shaped base portions received in the slots, a groove about the hub having a depth extending radially inwardly of the blade base portions in the slots and adjacent axial end faces of the blade base portions, the groove lying in a plane normal to the axis and having a base, a plurality of arcuate segments disposed in the groove in a circumferential array thereof and having portions extending radially outwardly along the axial end faces of the blades to engage and retain the blades against axial movement past the segments, at least one of the arcuate segments having a radial extent no greater than the depth of the groove so that one segment is spaced from the base of the groove when the radially extending portion of the one segment engages and retains an axially adjacent blade against the axial movement and means for retaining one segment spaced from the base of the groove in engagement with the axially adjacent blade.

In a further preferred embodiment according to the present invention, there is provided a blade retention system for a rotating machine comprising a hub having an axis and a plurality of shaped, generally axially extending slots at circumferentially spaced positions about the hub, a plurality of blades having complementary-shaped base portions received in the slots, a groove about the hub having a depth extending radially inwardly of the blade base portions in the slots and adjacent axial end faces of the blade base portions, the groove lying in a plane normal to the axis and having a base, a plurality of arcuate segments disposed in the groove in a circumferential array thereof and having portions extending radially outwardly along the axial end faces of the blades to engage and retain the blades against axial movement past the segments, at least one of the arcuate segments having a radial extent no greater than the depth of the groove so that one segment is spaced from the base of the groove when the radially extending portion of the one segment engages and retains an axially adjacent blade against the axial movement and a retaining element cooperable between the hub and one segment for retaining the one segment spaced from the base of the groove and in engagement with the axially adjacent blade.

In a still further preferred embodiment according to the present invention, there is provided a method of installing a retention system for retaining blades against axial movement relative to a hub mounting the blades and having an axis, the hub having shaped, generally axially extending slots for receiving complementary-shaped base portions of blades circumferentially spaced about the hub and a groove adjacent end faces of the blade portions lying in a common plane normal to the axis, comprising the steps of (a) locating at least one or a group of blade base portions in one or a group of complementary-shaped slots, respectively, of the hub, (b) inserting an arcuate segment in the groove and displacing the segment in a circumferential direction along the groove to locate a radial portion of the segment in general axial alignment with one or group of blade base portions, (c) repeating steps (a) and (b), (d) inserting a final arcuate segment in a location in the groove to enable a final one or group of blade base portions of the blades to pass axially over the groove and final segment into a final one or group of the complementary-shaped slots of the hub, (e) inserting a final one or group of base blade portions in the final one or group of complementary-shaped slots of the hub and (f) raising the final arcuate segment in a radially outward direction to locate a portion thereof radially outwardly of the groove and in general axial alignment with the final one or group of blade base portions thereby to retain the blades against axial movement past the segments.

In a still further preferred embodiment according to the present invention, there is provided a blade retention system for a rotating machine comprising a hub having an axis and a plurality of shaped, generally axially extending slots at circumferentially spaced positions about the hub, a plurality of blades having complementary-shaped base portions received in the slots, the slots and the base portions being shaped to enable only substantially axial movement of the slots and base portions relative to one another when the base portions are received in the slots, each base portion having a tab extending generally axially from one end thereof and a generally radially directed opening extending through the tab, the hub having a portion in each slot in substantial radial registry with the tab when the base portion of each blade is received in the slot, the hub portion including an opening extending generally radially and in radial registration with the tab opening when the base portion is received in the slot and a pin received in the registering openings to maintain the blade against axial movement in the slot.

Accordingly, it is a primary object of the present invention to provide a novel and improved retention system for the blades of a rotating machine for preventing the blades from axial movement without axially extending the length of the spool and to methods of installation of the retention assembly.

BEST MODE FOR CARRYING OUT THE INVENTION

Figure 1:
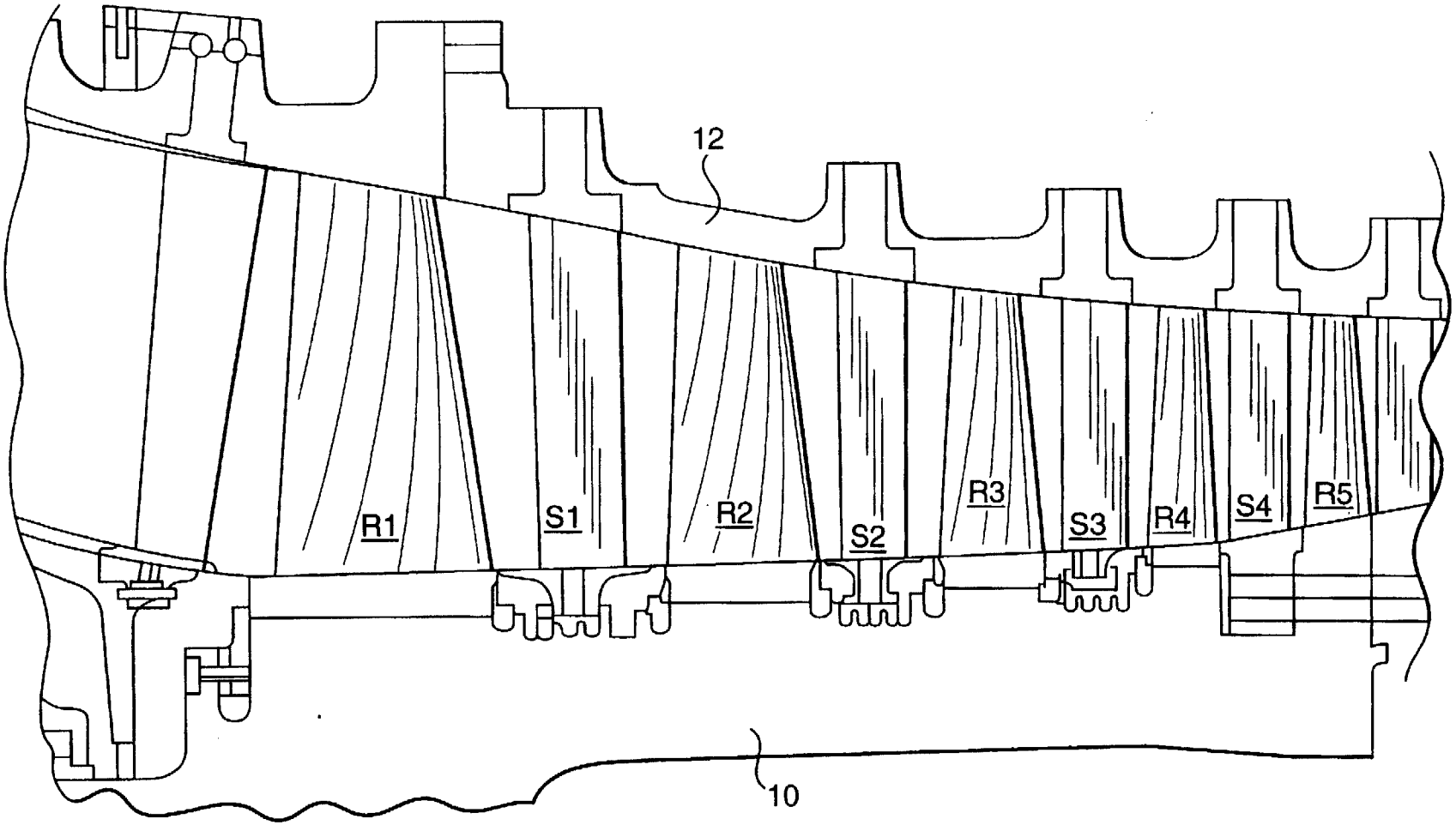
FIG. 1 is a fragmentary side elevational view of a portion of a rotary machine, for example, a compressor, employing the blade retention system according to the present invention.
Figure 3:
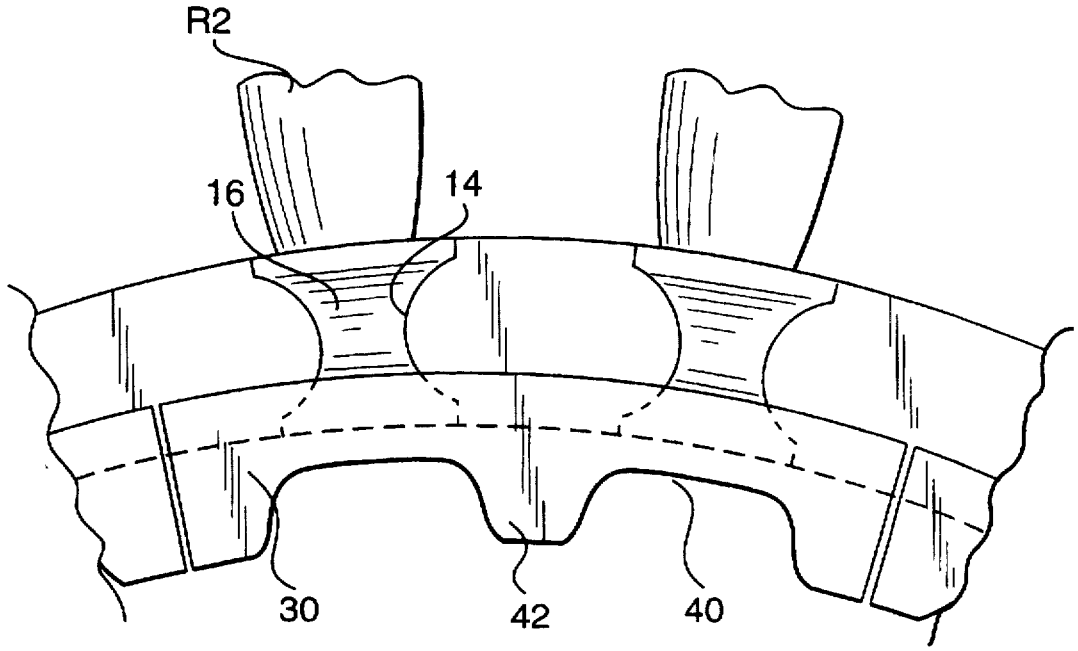
FIG. 3 is a fragmentary front elevational view of the retention system illustrated in FIG. 2.

Referring now to the drawings, particularly to FIGS. 1 and 3, there is illustrated a compressor section of a rotary machine, for example, a gas turbine, and including a spool 10, an outer casing 12, a plurality of stages, including fixed rows of stator blades S1, S2, S3, S4, etc., attached to outer casing 12, and a plurality of rows of rotor blades R1, R2, R3, R4 and R5, etc. carried by spool 10. It will be appreciated that each of the rotor blades R1, R2, R3 and R4 have base portions disposed in complementary-shaped slots 14 located at circumferentially spaced positions about the circumference of spool 10, the slots 14 and complementary base portions 16 being generally dovetail in shape. To mount the blades R along the spool, the base portion 16 of each blade is aligned in an axial direction with the complementary slot 14 and then displaced axially to engage within the slot 14. Referring to FIG. 1, it will be appreciated that each of the blades R1, R2, etc. can therefore be disposed in the space between the final position of the blade and an adjacent blade in an axial direction and then displaced axially into its corresponding slot into final position.

Figure 2:
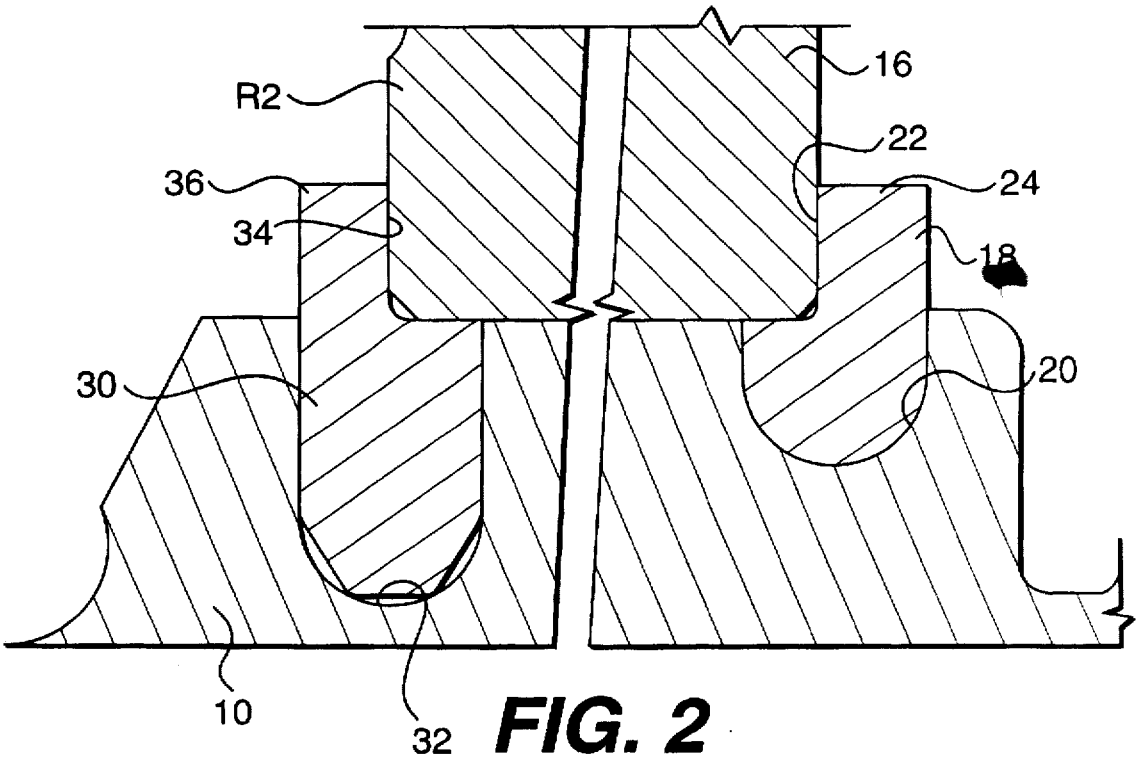
FIG. 2 is an enlarged fragmentary cross-sectional view of a portion of the spool, retention segments and base portion of a blade.

Referring now to the drawing FIGS. 1 and 2, a retention system according to a first embodiment of the present invention includes a plurality of arcuate segments disposed in grooves formed on the spool adjacent the opposite ends of the base portions 16 of the blades at each stage. For reference purposes, the aft retention segments lie on the aft side of the blades toward the turbine section, while the forward retention segments lie on the forward side of the blades opposite the turbine section. It will be appreciated that the retention system can be configured to be interchanged with the segments described as the forward segments forming aft segments and the segments described as the aft segments forming the forward segments. Referring to FIGS. 1 and 2, the aft retention segments may comprise, for example, two or more arcuate segments 18 disposed in an annular groove 20 formed about the spool 10 at a location adjacent the axial end face of the base portion 16 of the blades. While two arcuate segments of 180° length are preferred, it will be appreciated that additional segments, for example, three segments 120° in length or four segments 90° in length may be utilized. Suffice to say that the aft arcuate segments 18 are disposed in the groove 20 and that each segment has a step 22 defining a radial arcuate projection or flange 24 which, in final assembly, lies in axial registration or alignment with the aft face of the base portion 16 of the blades at that stage. Thus, by disposing the aft arcuate segments 18 in groove 20, the base portions 16 of the blades at the various stages can be axially displaced in the complementary slots 14 until the aft faces of the base portions 16 butt the radial projection 24, i.e., lie in bearing engagement in the step 22 of the aft segments.

Referring to FIGS. 2 and 3, the forward arcuate segments 30 are provided in shorter lengths. For example, twelve segments each 30° in length may be provided. The forward segments are disposed in an annular groove 32 formed about the spool 10 adjacent the forward end faces of the base portion 16 of the blades. The forward segments 30 have a greater radial extent than the aft segments 18 and a deeper groove 32. Similar to the aft segments 18, the forward segments 30 have a step 34 defining a radial projection or flange 36 for overlying the forward end faces of the base portions 16 of the blades. As illustrated in FIG. 3, the forward segments 30 have a plurality of recesses 40 at circumferentially spaced positions about each segment along its radial inner side, thus defining radially inwardly directed projections 42. The projections 42 engage the bottom of the groove 32.

Figure 4A:
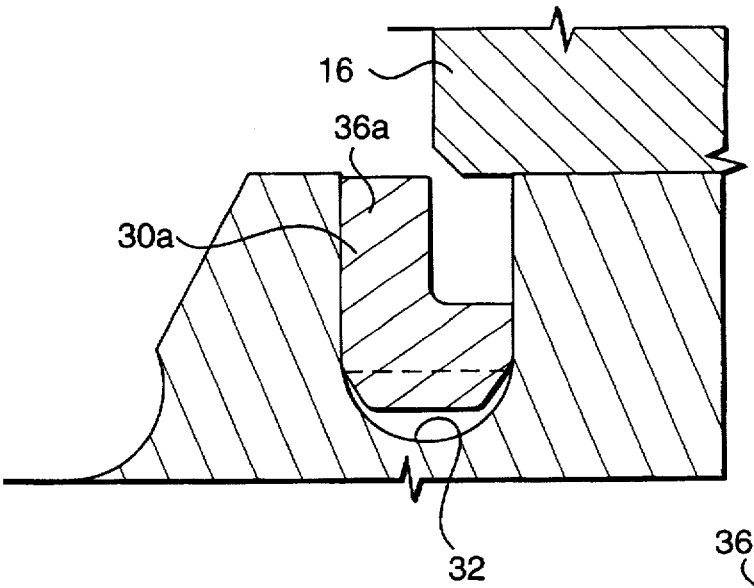
FIGS. 4A and 4B are fragmentary cross-sectional views illustrating the installation of the final arcuate segment of the blade retention system hereof.
Figure 4B:
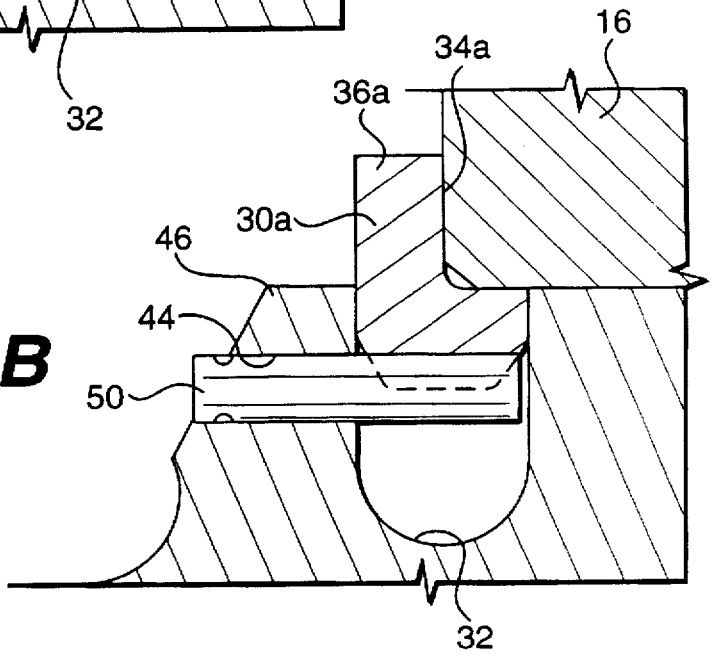
Figure 5:
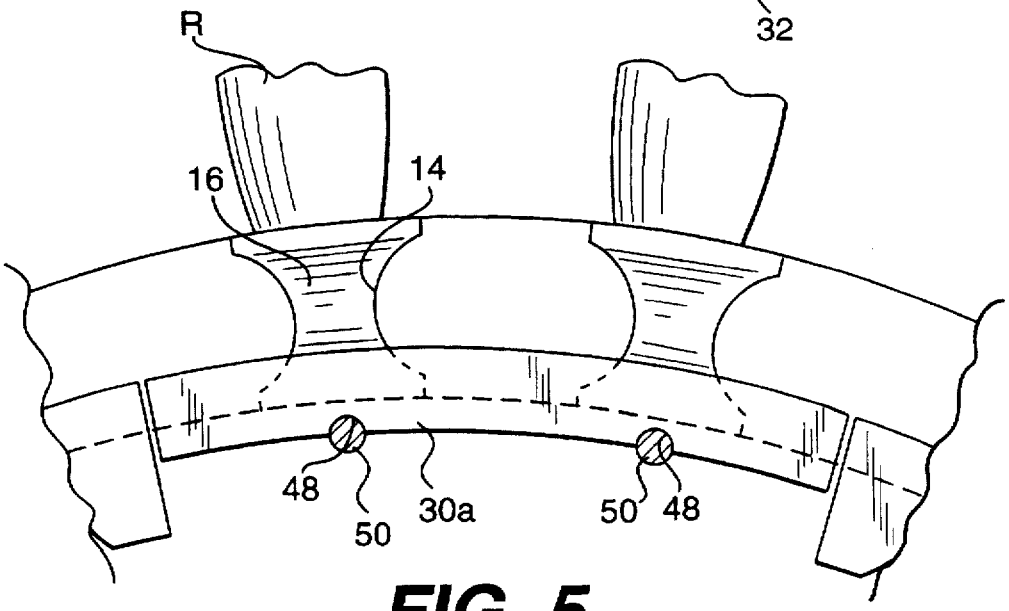
FIG. 5 is a front elevational view of the final segment of the retention system.
Figure 7:
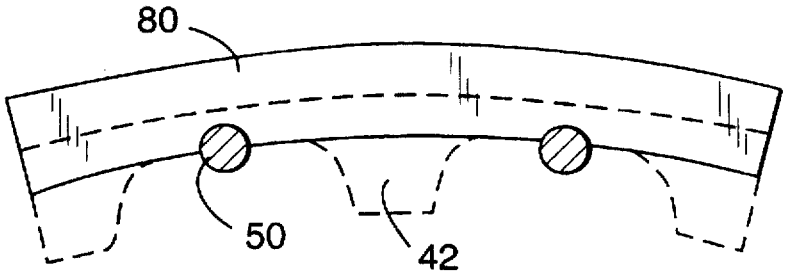
FIG. 7 is a front elevational view illustrating the commonality of the arcuate segments for the blade retention system hereof.

Referring now to FIGS. 4 and 5, there is illustrated a final forward segment or segments 30*a*. The final segment or segments 30*a* may comprise one or a pair of the forward arcuate segments 30 which have the projections 42 removed. Consequently, the final segment or segments 30*a* have a radial extent less than the other forward segments 30. In FIG. 7, the difference between the forward segments 30 and the final segment 30*a* is shown by the dashed line projections 42, the segments 30*a* being devoid of projections 42. The final segments 30*a* are similar in other respects to the segments 30.

Figure 6:
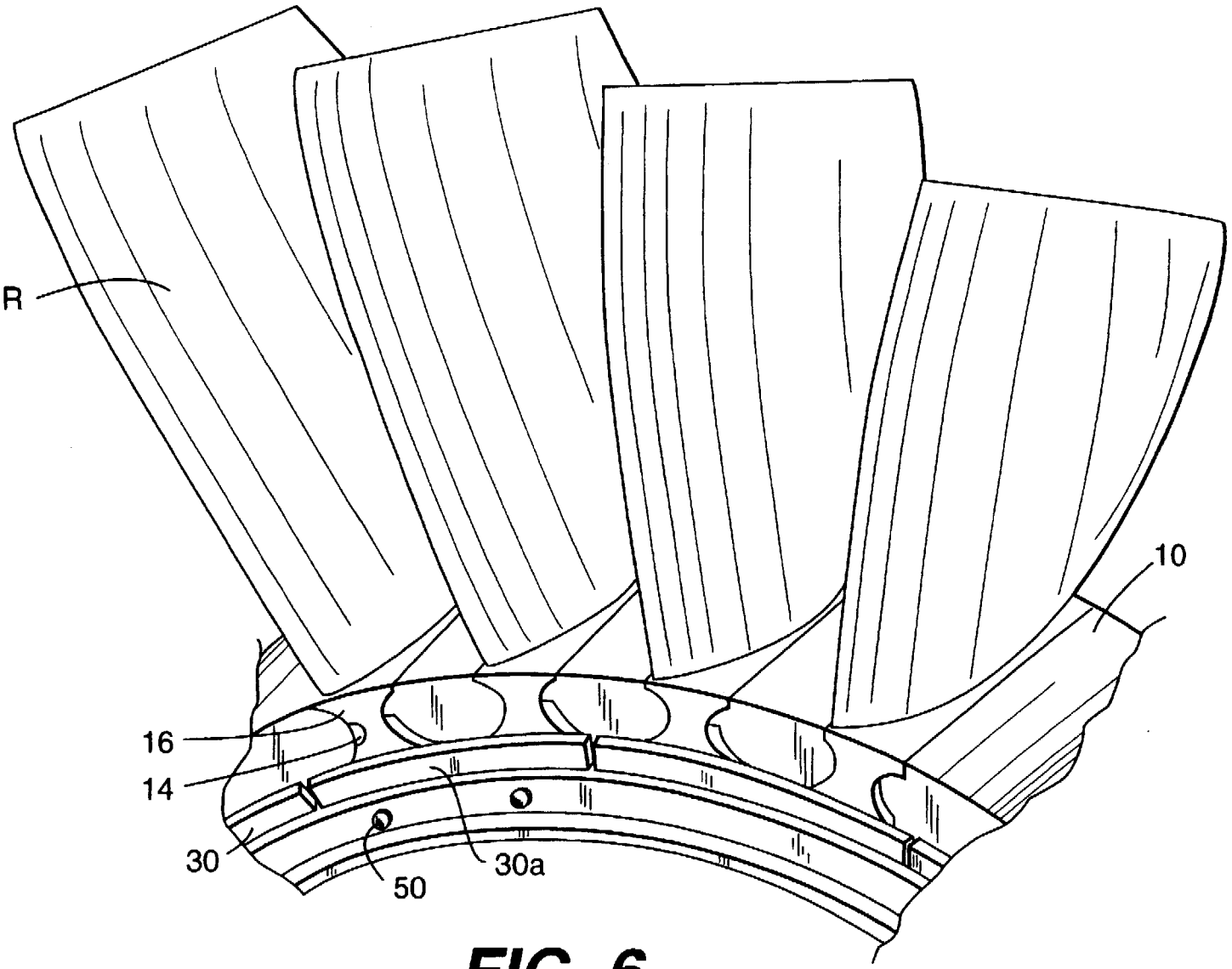
FIG. 6 is a fragmentary perspective view illustrating a portion of the blade retention system hereof.

To install the retention system of this embodiment of the present invention, the aft arcuate segments 18 are preferably disposed in the aft groove 20 with the radial flange 24 projecting radially outwardly of the spool 10. One or preferably a pair of blades are disposed in the slots 14 as shown in FIG. 6. Particularly, the base portions of the blades are first aligned at the forward ends of the dovetail slots 14 and then displaced axially in an aft direction such that the axial aft faces of the base portion 16 abut the radial projection 24. With the first pair of blades in their slots 14, a forward segment 30 is disposed in the groove 32 at a location circumferentially spaced from the location of the first pair of blades. By displacing this first segment 30 circumferentially in the groove 32, the radial projection 36 is aligned with the axial forward faces of the base portions 16 of the blades. In this manner, the initially installed pair of blades are retained between the aft and forward segments.

An additional one or more blades, preferably an additional pair thereof, are similarly disposed in the next pair of slots 14 and abut the aft segment 18. A further forward arcuate segment 30 is disposed in groove 32 at a circumferential location spaced from the newly-installed or second pair of blades. This second segment 30 is then displaced circumferentially in the groove to align its radial projection 36 with the forward axial end faces of the base portions 16 of the second pair of blades. This process of installing one and preferably a pair of blades with each arcuate segment 30 being disposed in the groove 32 adjacent the circumferential location of the newly-installed blades and then displaced circumferentially to secure the blades is repeated until all but the final one or two blades are installed.

To install the final blades, a final forward arcuate segment 30*a* is disposed in the groove 32 at the remaining location of the groove adjacent the final blade position and between circumferentially adjacent segments 30. As illustrated in FIG. 4A, the final segment 30*a* is disposed in groove 32 such that the radially outer face of the flange 36*a* lies generally flush with the annular surface of the spool. Consequently, the final blade or blades may be disposed in axial alignment with the complementary slots 14 and displaced axially into engagement with the aft segment 18. By locating the final segments 30*a* deeply within the groove 32, the base portions of the final blade or blades are permitted to pass over the final segment 30a. When the final blades are in place, the final arcuate segment 30a is elevated or displaced radially outwardly as in FIG. 4B such that its step portion 34a engages the forward end faces of the final blades. To maintain the final segment 30a in its raised position in groove 32, a pair of pins 50 are disposed in an axial direction through apertures 44 of the disk post 46. The pins 50 engage in corresponding arcuate grooves 48 formed along the radial undersurface of the final segment 30a. The pins 50 are then secured, preferably staked to the disk post 46 to secure the pins and the final segment 30a in place. Other types of securing means for retaining the segment(s) 30a raised in the groove may be provided. For example, the segment 30a may be bolted, welded or clamped in the raised position. The system may employ two or more of the final arcuate segments 30a as desired with each final segment being pinned in a raised position relative to the groove as indicated above for the one final segment.

Referring back to FIG. 1, the forward arcuate segments 30 are employed along the forward sides of the blades for rotor stages R2, R3 and R4, while the aft segments 18 are disposed along the aft sides of rotor stages R1, R2 and R3. The blade retention system for the forward side of stage R1 may be a conventional system, for example, a bolted system as illustrated, or may comprise the forward segments of the present invention. The aft retention system for the blades of rotor stage R4 may likewise comprise a conventional bolted system.

Referring again to FIG. 7, the difference between the plurality of forward segments 30 and the final segment or segments 30a resides in the radial inward projections 42 on segments 30. Those projections, however, are removed on the final segments 30a as indicated by the dashed lines in FIG. 7. Consequently, the fabrication process for the segments is simplified with the segments 30 requiring only removal of the projections 42 to form the final segments 30a.

Figure 8:
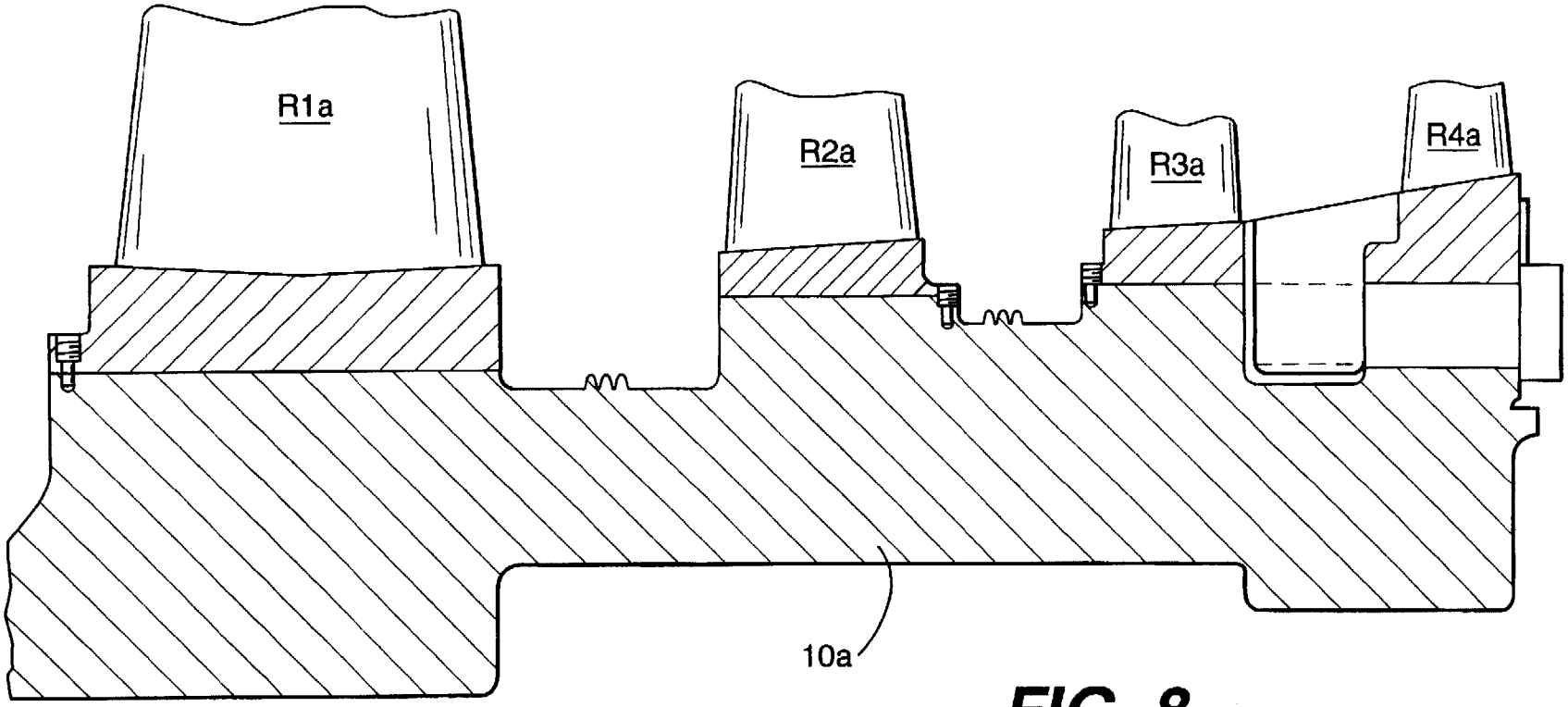
FIG. 8 is a further fragmentary side elevational view of a portion of a rotary machine, for example, a compressor, employing a blade retention system according to a second embodiment of the present invention.

Referring now to the second embodiment of the invention illustrated in FIGS. 8–13, there is illustrated in FIG. 8 a further example of a rotary machine, for example, a compressor, including a spool 10a having a plurality of stages of rotor blades R1a, R2a, R3a and R4a. It will be appreciated that the stator blades corresponding to the various stages of the rotor blades are not shown for clarity. As in the first embodiment, and as illustrated in FIGS. 9A and 9B, the rotor disk includes a shaped slot 14a for receiving the base portion 16a of each blade of the first rotor stage. The slots 14a and blade base portions 16a of the stator array of the first stage are arranged generally axially of the rotor axis such that each blade may be aligned in an axial direction with the complementary slot and displaced axially to engage within the complementary-shaped slot.

Figure 9B:
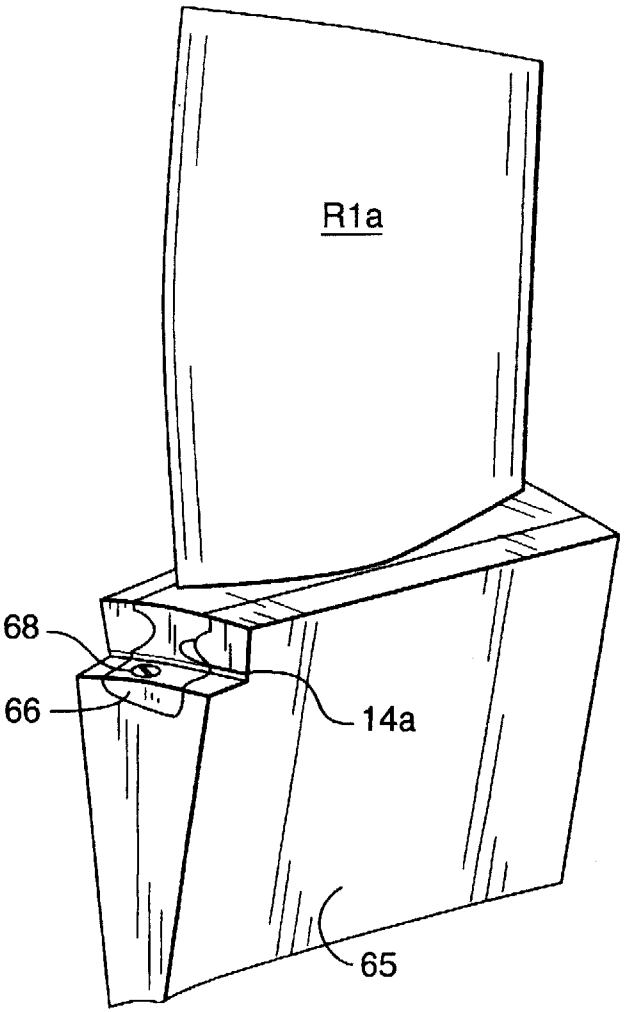
FIG. 9B is a view similar to FIG. 9A illustrating the blade disk and portion thereof in assembled condition.
Figure 9A:
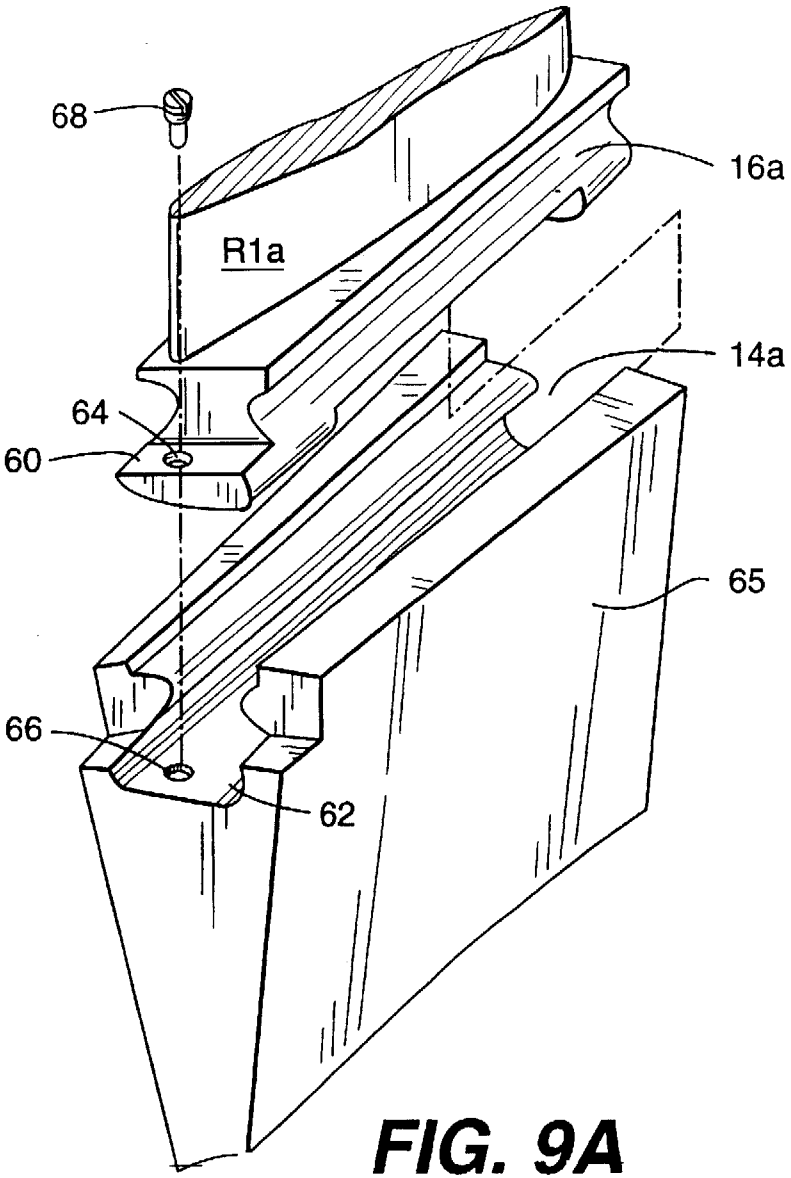
FIG. 9A is an exploded perspective view of a blade dovetail and disk portion for a first rotor stage according to the second embodiment hereof.

As illustrated in FIGS. 9A and 9B, the base 16a of each blade R1a has a forward, generally axially extending tab 60 along a bottom or radially inner portion of the base 16a. The disk has a radially reduced forward portion or cutout 62 for receiving the tab 60 when the base portion 16a of blade R1a is disposed in the slot 14a.

Figure 13:
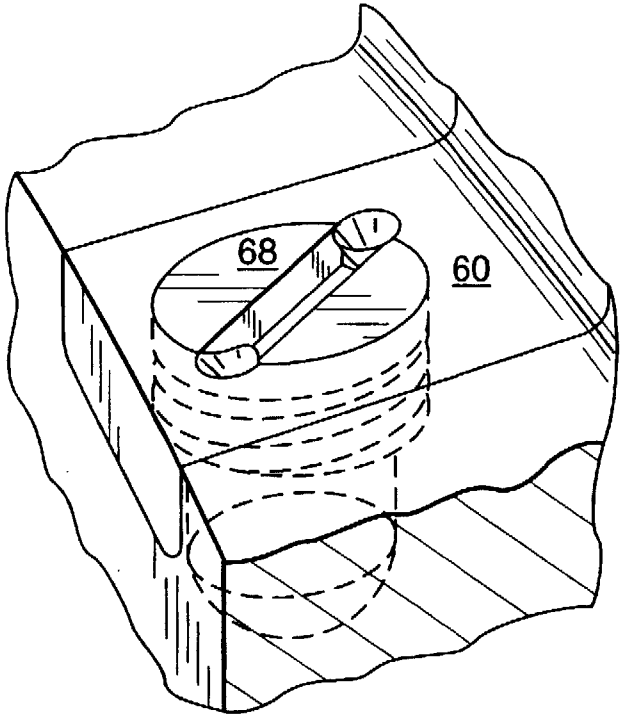
FIG. 13 is a perspective view illustrating the staking of the pin in final position.
Figure 12:
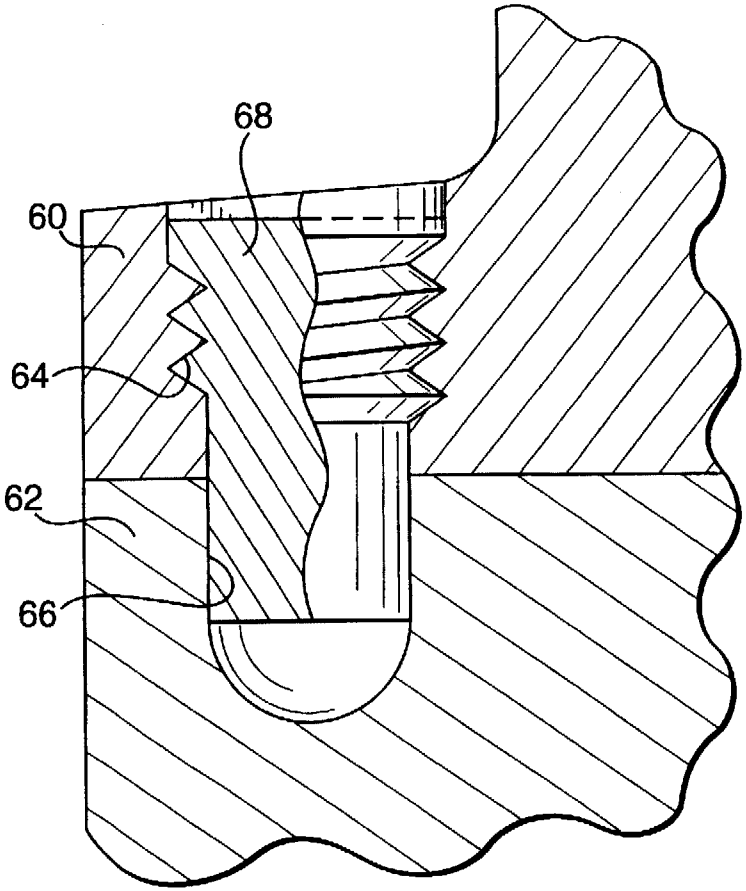
FIG. 12 is an enlarged cross-sectional area illustrating the pinned connection between the blade dovetail and disk with portions of the pin being illustrated in elevation.

As illustrated, the tab 60 has a partially threaded opening 64 extending in a generally radial direction, while the disk portion 65 has a bore 66 in its forward portion 62 also extending in a generally radial direction. Thus, when the blade R1 a is finally installed in the disk, the opening 64 registers in a general radial direction with the opening 66. To secure the blade R1a in the rotor, a partially threaded pin 68 is disposed in the registering openings 64 and 66. Each pin 68 is threaded into the threaded opening 64 with an unthreaded end portion extending in the bore of opening 66. The final assembly of the pin 68 in the aligned openings 64 and 66 is illustrated in detail in FIG. 12. To prevent rotation of the pin in the aligned openings, the pin may be staked as illustrated in FIG. 13 after final assembly. With the pin inserted into the aligned holes, the blades are accurately axially aligned on the disk. It will be appreciated that with this type of construction, no additional axial space is necessary to secure the blades of the first stage to the rotor.

Figure 10B:
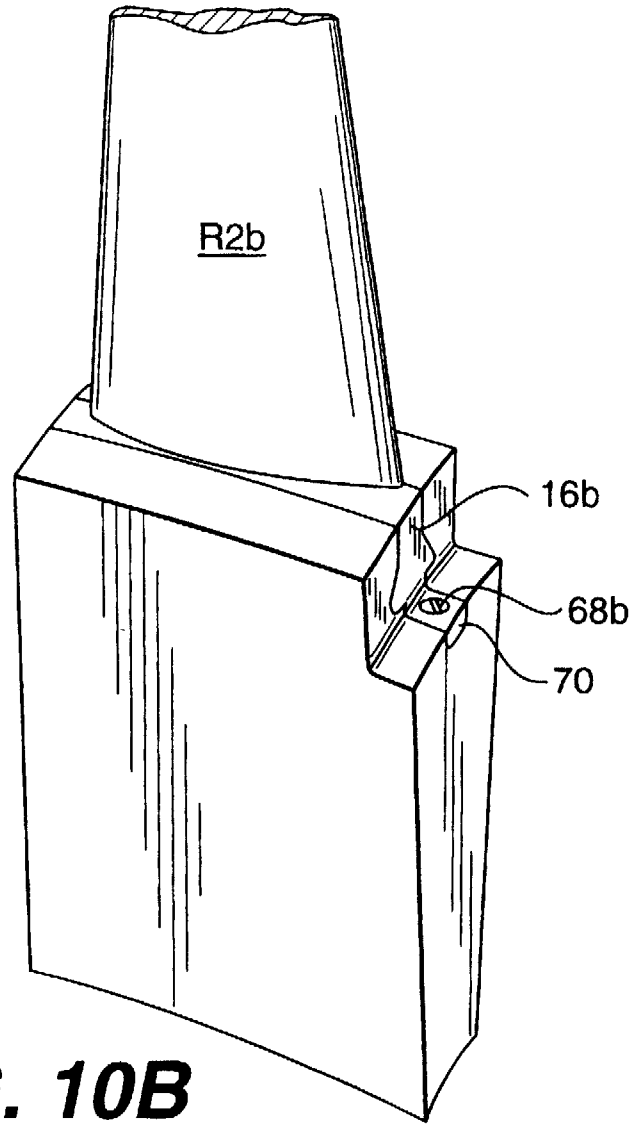
FIG. 10B is a view similar to FIG. 10A showing the blade and disk portion in assembled condition.
Figure 10A:
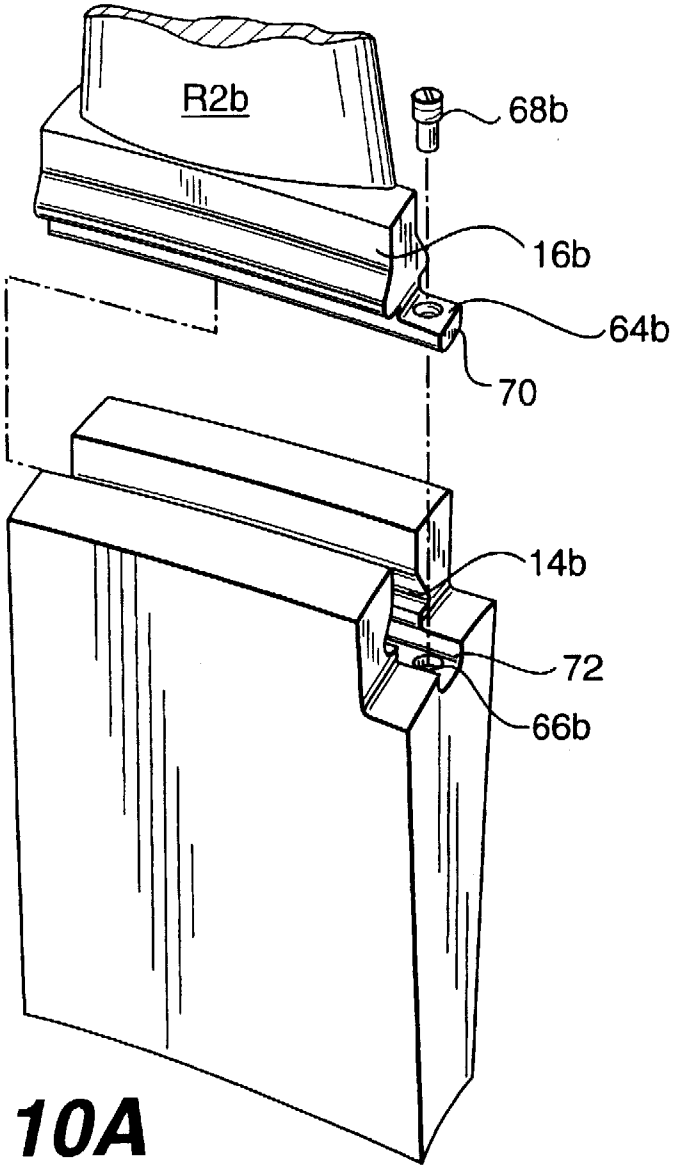
FIG. 10A is a view similar to FIG. 9A illustrating a blade dovetail and disk portion for a second rotor stage.

Referring to FIGS. 10A and 10B, the second-stage rotor blades R2b may similarly be secured in the rotor disks against axial movement by a similar arrangement with the tabs, however, projecting in an aft direction. Thus, the base portion 16b of the blade R2b and its complementary slot 14b in the rotor disk have a rearwardly projecting tab 70 and radially reduced portion 72, respectively. The tab 70 and reduced portion 72 have openings 64b and 66b, respectively, which are aligned with one another upon full axial insertion of the base portion 16b into the complementary slot 14b. Thus, upon axial insertion of the base portion 16b of the rotor blades R2b into the complementary-shaped slots 14b in the second stage, the holes 64b and 66b are generally radially aligned. Pins 68b, similar to the pins 68 described above, are then inserted into the aligned openings to retain the blades R2b against axial movement relative to the rotor disk. The pins are then staked as previously described.

Figure 11B:
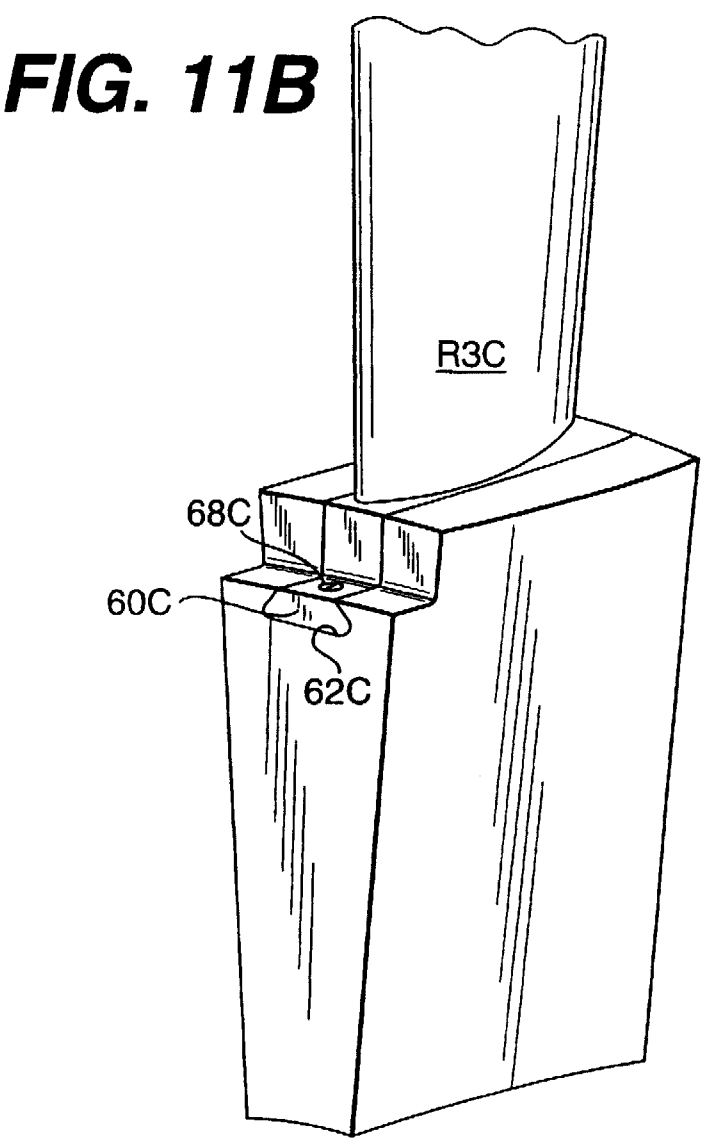
FIG. 11B is a view similar to FIG. 11A illustrating the blade and disk portion of the third rotor in assembly.
Figure 11A:
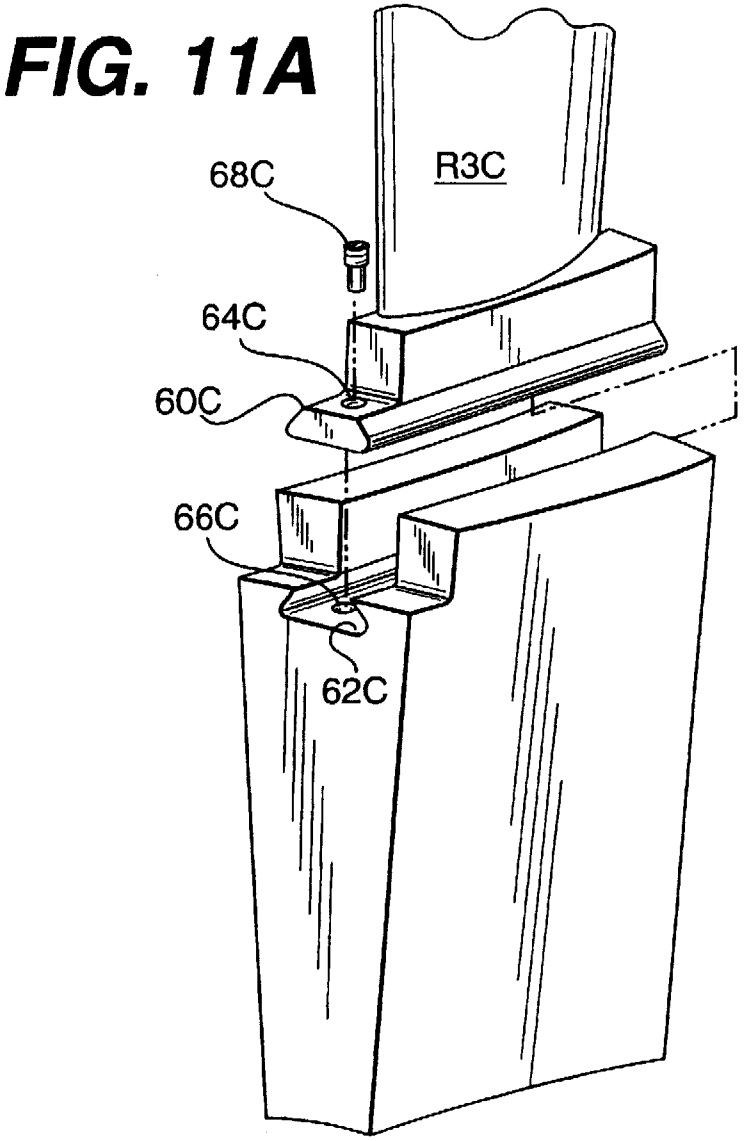
FIG. 11A is a view similar to FIG. 9A illustrating a blade dovetail and disk portion for a third rotor stage.

Referring now to FIGS. 11A and 11B, the blades R3c of the third stage of the rotor have forwardly directed tabs 60c, while the rotor disk has forwardly directed reduced portions 62c. The forwardly directed tab 60c of each blade also includes a half-threaded opening 64c for generally radial registration with the opening 66c in the rotor disk. Thus, upon axial insertion of the base portions of the blades into the slots and alignment of the openings 64c and 66c, the blades R3c are in position for final securement by pins 68c in the manner previously described.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a turbomachinery blade having a dovetail portion shaped to fit into a complementary-shaped slot in a hub for rotation about a hub axis, the improvement comprising a tab integral with said dovetail portion and extending generally axially from one end thereof, said tab having an opening generally perpendicular to the hub axis and extending through said tab for receiving a pin for preventing axial movement of said blade within the slot.

2. A blade retention system for a rotating machine comprising:

a hub having an axis and a plurality of shaped, generally axially extending slots at circumferentially spaced positions about said hub;

a plurality of blades having complementary-shaped base portions received in said slots;

said slots and said base portions being shaped to enable only substantially axial movement of said slots and base portions relative to one another when said base portions are received in said slots;

each said base portion having a tab extending generally axially from one end thereof and a generally radially directed opening extending through said tab;

said hub having a portion in each said slot in substantial radial registry with said tab when said base portion of each blade is received in said slot, said hub portion including an opening extending generally radially and in radial registration with said tab opening when said base portion is received in said slot; and a pin received in the registering openings to maintain said blade against axial movement in said slot.

3. A system according to claim 2 wherein said pins are staked to said base portions.

4. A system according to claim 2 wherein said tabs extend in a generally forward or aft axial direction.

5. A system according to claim 2 wherein said blades and slots form a portion of a stage of the rotary machine, said tabs projecting axially solely from a common end of each blade of said stage portion.

6. A system according to claim 2 wherein the blades and slots form portions of a plurality of stages of the rotary machine, the tabs of said blades forming one of the stage portions extending generally axially in a forward direction and the tabs of said blades forming another of the stage portions extending generally axially in an aft direction.

* * * * *